US007028393B2

(12) United States Patent
Wei

(10) Patent No.: US 7,028,393 B2
(45) Date of Patent: Apr. 18, 2006

(54) CONTRACTION TOOL

(76) Inventor: Shu Chen Wei, No. 13-2, Dayou 2nd St., Shituen Chiu, Taichung City (TW) 407

( * ) Notice: Subject to any disclaimer, the term of this patent is extended or adjusted under 35 U.S.C. 154(b) by 348 days.

(21) Appl. No.: 10/446,678

(22) Filed: May 29, 2003

(65) Prior Publication Data

US 2004/0237621 A1 Dec. 2, 2004

(51) Int. Cl.
*B23P 19/00* (2006.01)

(52) U.S. Cl. ..... 29/761; 29/757; 29/758; 29/764; 29/278

(58) Field of Classification Search ..... 29/757, 29/758, 761, 764, 278, 280
See application file for complete search history.

(56) References Cited

U.S. PATENT DOCUMENTS 3,757,406 A * 9/1973 Bezar ..... 29/741
5,479,669 A * 1/1996 Chen ..... 7/107
5,647,119 A * 7/1997 Bourbeau et al. ..... 29/751
5,875,544 A * 3/1999 Chou ..... 29/741
5,934,137 A * 8/1999 Tarpill ..... 72/409.14
6,272,738 B1 * 8/2001 Holliday et al. ..... 29/751
6,293,004 B1 * 9/2001 Holliday ..... 29/751

FOREIGN PATENT DOCUMENTS

JP 05234658 A * 9/1993 ..... 29/751

* cited by examiner

*Primary Examiner*—David P. Bryant
*Assistant Examiner*—Sarang Afzali
(74) *Attorney, Agent, or Firm*—Charles E. Baxley

(57) ABSTRACT

A contraction tool includes a main body, and a pressing unit mounted on the main body. The pressing unit includes two press plates each having an upper section formed with a positioning recess and a lower section formed with a tapered face. The contraction tool further comprises a push rod moved relative to the main body and inserted into the positioning recesses of the two press plates of the pressing unit, and an urging member mounted on the push rod to move therewith synchronously and inserted between the tapered faces of the two press plates of the pressing unit. Thus, the contraction tool has an enhanced pressing force and is operated easily and conveniently.

16 Claims, 8 Drawing Sheets

CONTRACTION TOOL

BACKGROUND OF THE INVENTION

1. Field of the Invention

The present invention relates to a contraction tool, and more particularly to a contraction tool for pressing and forcing a terminal head into the end portion of a cable.

2. Description of the Related Art

Conventionally, a terminal head is inserted into the end portion of a cable, and a metallic clamp is clamped on the end portion of a cable, thereby combining the terminal head with the end portion of a cable. However, the clamping effect of the metallic clamp is not large enough, so that the terminal head is easily detached from the end portion of a cable during a long-term utilization.

SUMMARY OF THE INVENTION

The primary objective of the present invention is to provide a contraction tool having an enhanced pressing force.

Another objective of the present invention is to provide a contraction tool that is operated easily and conveniently.

In accordance with the present invention, there is provided a contraction tool for terminating a cable with a connector, comprising a main body, a press rod pivotally mounted on a first end of the main body, and a pressing unit mounted on a second end of the main body, wherein:

the pressing unit includes two press plates each pivotally mounted on the second end of the main body;

each of the two press plates of the pressing unit has an upper section formed with a positioning recess for holding said connector and a lower section formed with a tapered face;

the contraction tool further comprises a push rod that is movable relative to the main body toward the positioning recesses of the two press plates of the pressing unit;

the contraction tool further comprises an urging member mounted on the push rod to move therewith synchronously; and the urging member contacts the tapered faces of the two press plates of the pressing unit when the push rod is advanced toward the positioning recesses of the two press plates of the pressing unit to cause the upper sections of the two press plates to pivot toward each other.

Further benefits and advantages of the present invention will become apparent after a careful reading of the detailed description with appropriate reference to the accompanying drawings.

DETAILED DESCRIPTION OF THE INVENTION

Figure 1:
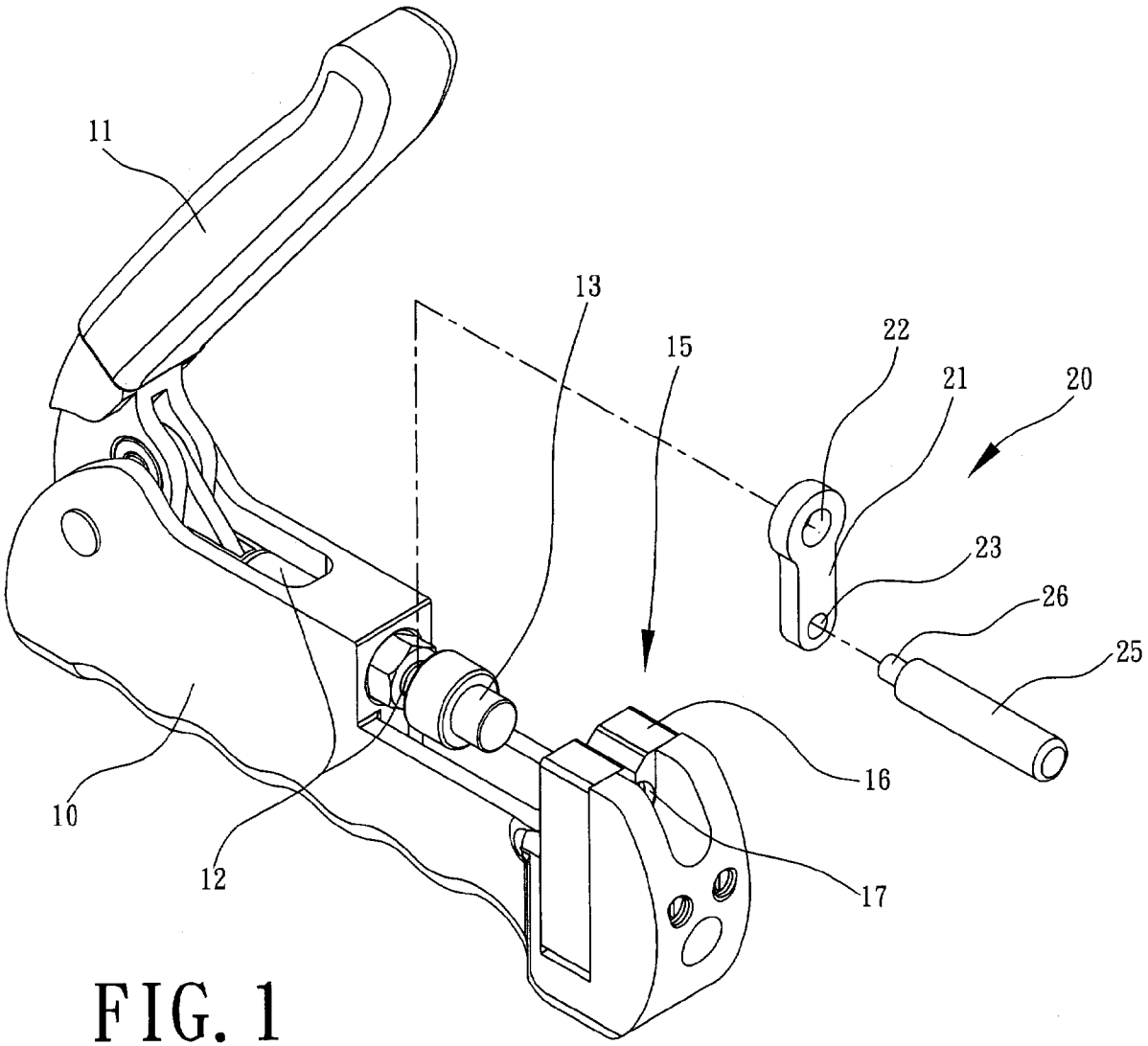
FIG. 1 is a partially exploded perspective view of a contraction tool in accordance with the preferred embodiment of the present invention.

Referring to the drawings and initially to FIGS. 1–4, a contraction tool in accordance with the preferred embodiment of the present invention comprises a main body 10, a press rod 11 pivotally mounted on a first end of the main body 10, and a pressing unit 15 mounted on a second end of the main body 10.

The pressing unit 15 includes two press plates 16 each pivotally mounted on the second end of the main body 10. Each of the two press plates 16 of the pressing unit 15 has an upper section formed with a positioning recess 17 and a lower section formed with a tapered face 18. The tapered face 18 of each of the two press plates 16 of the pressing unit 15 is directed outward. Each of the two press plates 16 of the pressing unit 15 has a mediate section formed with a plurality of ratchet teeth 19. The ratchet teeth 19 of the two press plates 16 of the pressing unit 15 mesh with each other, so that the two press plates 16 of the pressing unit 15 are pivoted relative to each other in a synchronous manner.

The contraction tool further comprises a movable shaft 12 movably mounted in the main body 10 and having a first end pivotally connected to the press rod 11 so that the movable shaft 12 can be linearly moved in the main body 10 by pivot of the press rod 11, and a push rod 13 secured on a second end of the movable shaft 12 to move therewith and protruded outward from the main body 10. The second end of the movable shaft 12 is formed with an inner thread 120, and the push rod 13 has a first end formed with a threaded rod 14 screwed into the inner thread 120 of the movable shaft 12, so that the push rod 13 is secured on the movable shaft 12 to move therewith. In addition, the push rod 13 has a second end facing the positioning recesses 17 of the two press plates 16 of the pressing unit 15.

The contraction tool further comprises an urging member 20 mounted on the push rod 13 to move therewith. The urging member 20 includes a linking plate 21 having a first end mounted on the threaded rod 14 of the push rod 13 to move therewith, and a limit rod 25 having a first end secured on a second end of the linking plate 21 and a second end facing the tapered faces 18 of the two press plates 16 of the pressing unit 15. The first end of the linking plate 21 of the urging member 20 is formed with a mounting hole 22 for mounting the threaded rod 14 of the push rod 13. The second end of the linking plate 21 of the urging member 20 is formed with an insertion hole 23, and the first end of the limit rod 25 of the urging member 20 is formed with a locking end 26 inserted into and locked in the insertion hole 23 of the linking plate 21, so that the limit rod 25 is secured on the linking plate 21 to move therewith.

Figure 7:
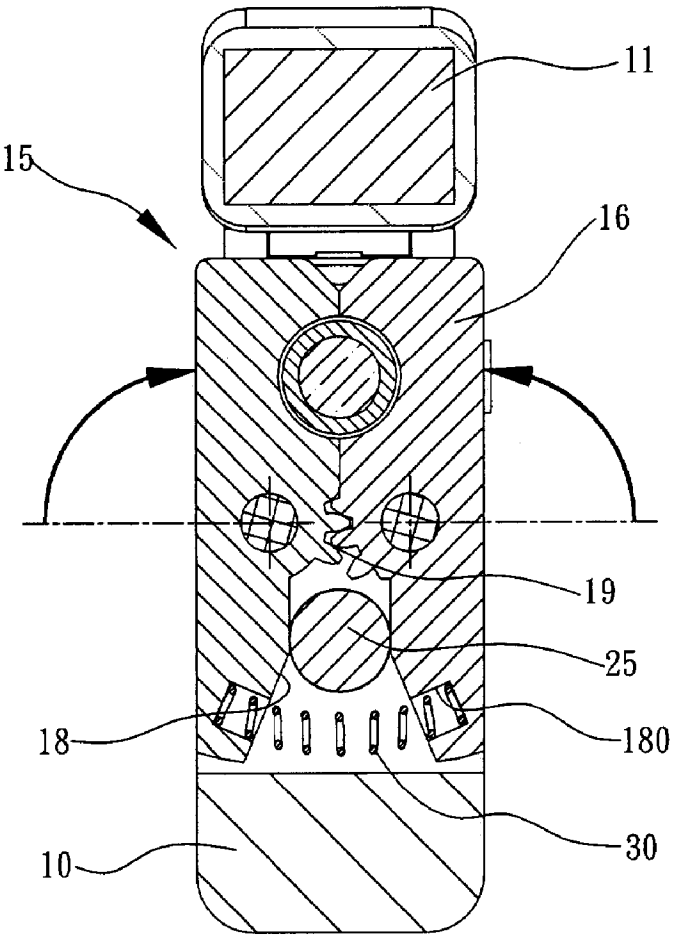
FIG. 7 is a schematic operational view of the contraction tool as shown in FIG. 4 in use.

Thus, the urging member 20 and the push rod 13 are moved toward the pressing unit 15 synchronously, so that the limit rod 25 of the urging member 20 can be inserted between the tapered faces 18 of the two press plates 16 of the pressing unit 15 to close the upper sections of the two press plates 16 of the pressing unit 15 as shown in FIG. 7.

The contraction tool further comprises a spring 30 mounted between the tapered faces 18 of the two press plates 16 of the pressing unit 15. Preferably, the tapered face 18 of each of the two press plates 16 of the pressing unit 15 is formed with a receiving hole 180 to receive an end of the spring 30.

Figure 2:
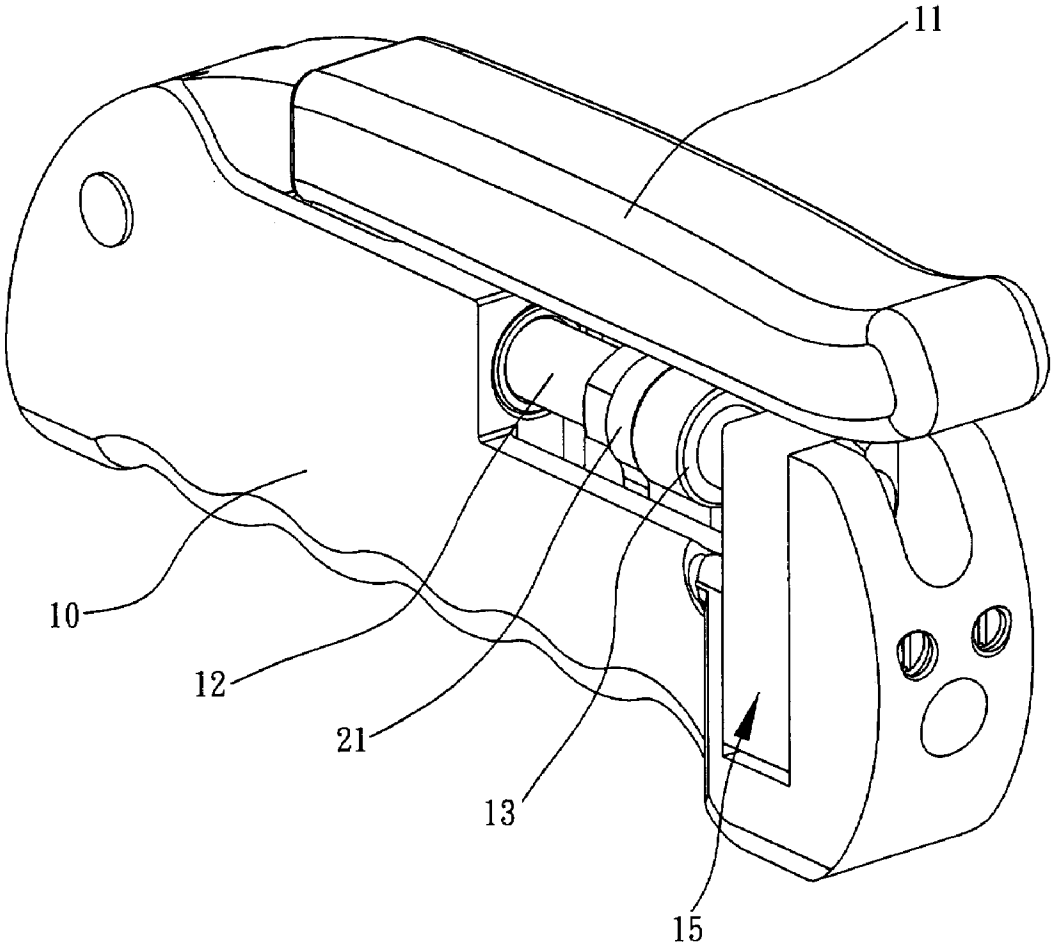
FIG. 2 is a perspective assembly view of the contraction tool in accordance with the preferred embodiment of the present invention.
Figure 3:
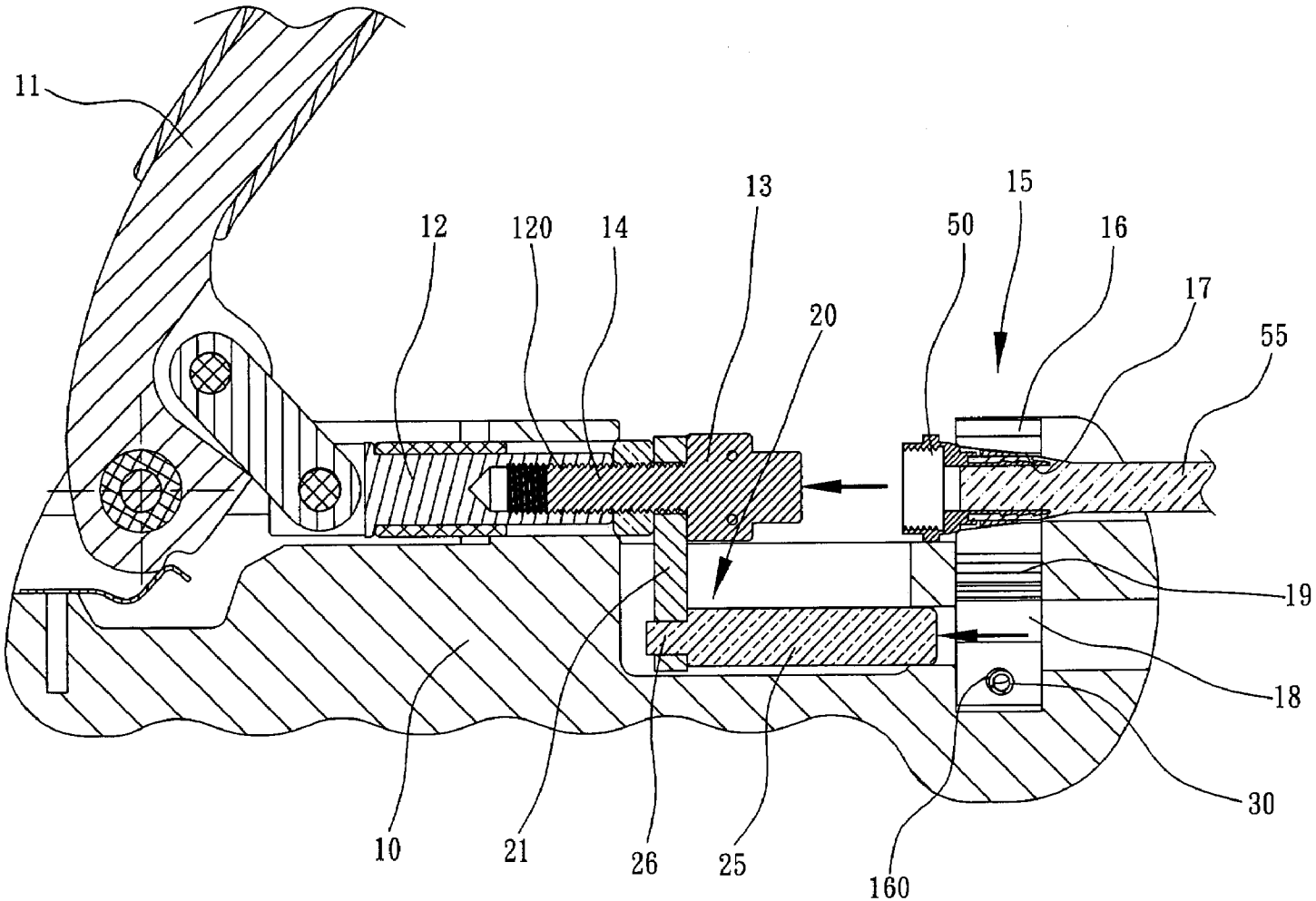
FIG. 3 is a side plan cross-sectional assembly view of the contraction tool as shown in FIG. 1.
Figure 4:
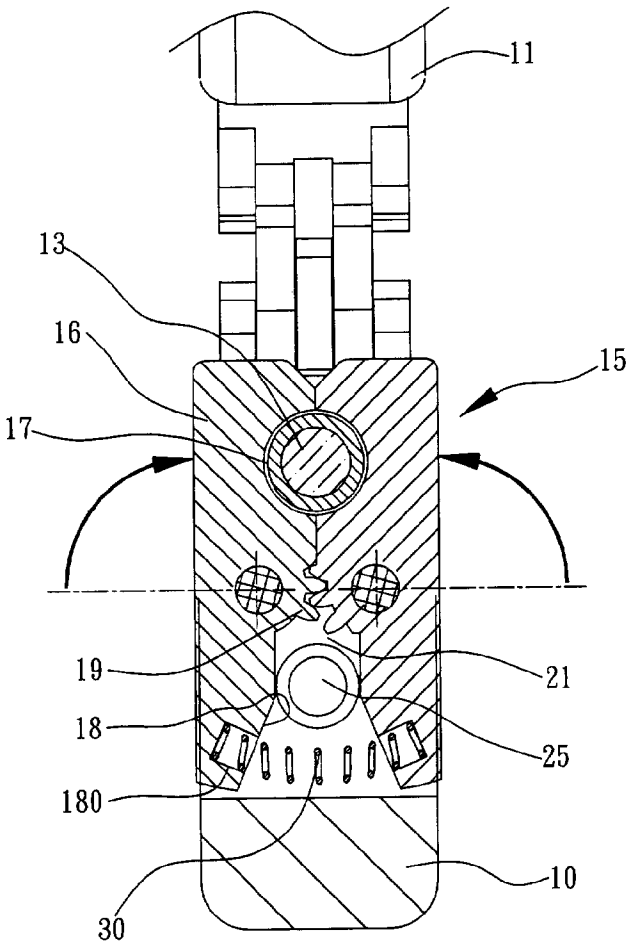
FIG. 4 is a front plan cross-sectional assembly view of the contraction tool as shown in FIG. 1.

In operation, referring to FIGS. 3–7 with reference to FIGS. 1 and 2, when the press rod 11 is pivoted upward relative to the main body 10 as shown in FIG. 3, the movable shaft 12 is moved backward by pivot of the press rod 11 to pull the push rod 13 backward, so that the limit rod 25 of the urging member 20 is also moved backward to detach from the tapered faces 18 of the two press plates 16 of the pressing unit 15 so as to close the upper sections of the two press plates 16 of the pressing unit 15 by the pressing force of the spring 30 as shown in FIG. 4.

Figure 5:
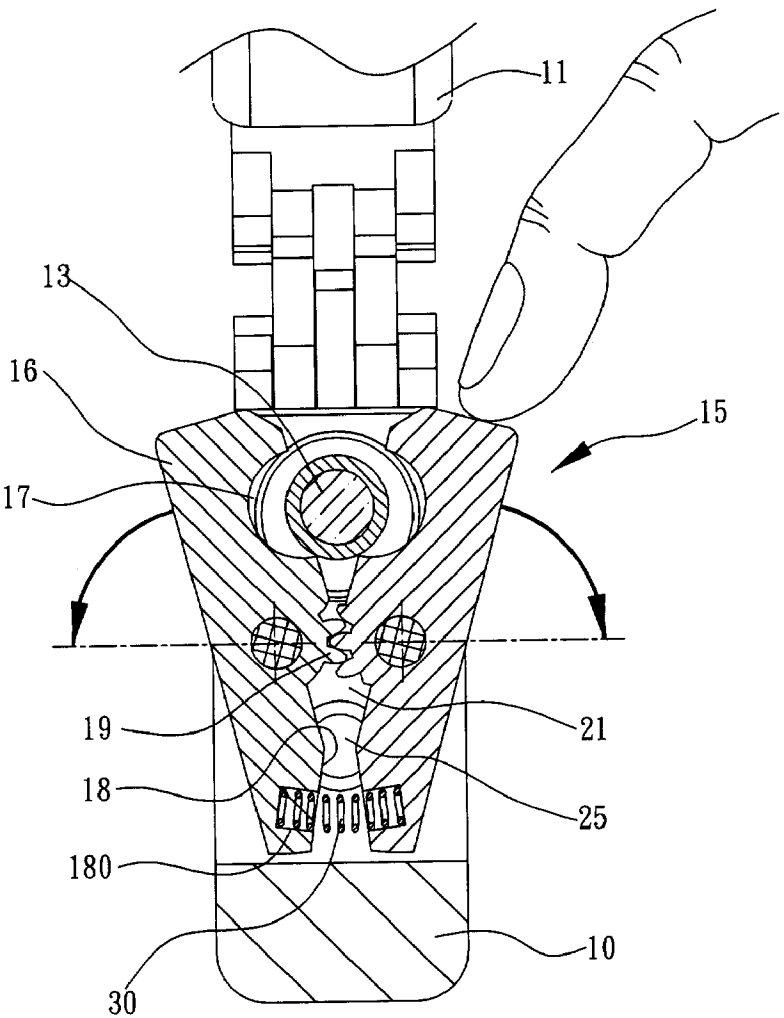
FIG. 5 is a schematic operational view of the contraction tool as shown in FIG. 4 in use.

When the user wishes to combine the terminal head 50 with an end portion of the cable 55, one of the two press plates 16 of the pressing unit 15 can be pressed and moved outward by the user's one finger, so that the two press plates 16 of the pressing unit 15 can be synchronously pivoted outward relative to each other as shown in FIG. 5, thereby facilitating the user placing the terminal head 50 between the positioning recesses 17 of the two press plates 16 of the pressing unit 15.

Figure 6:
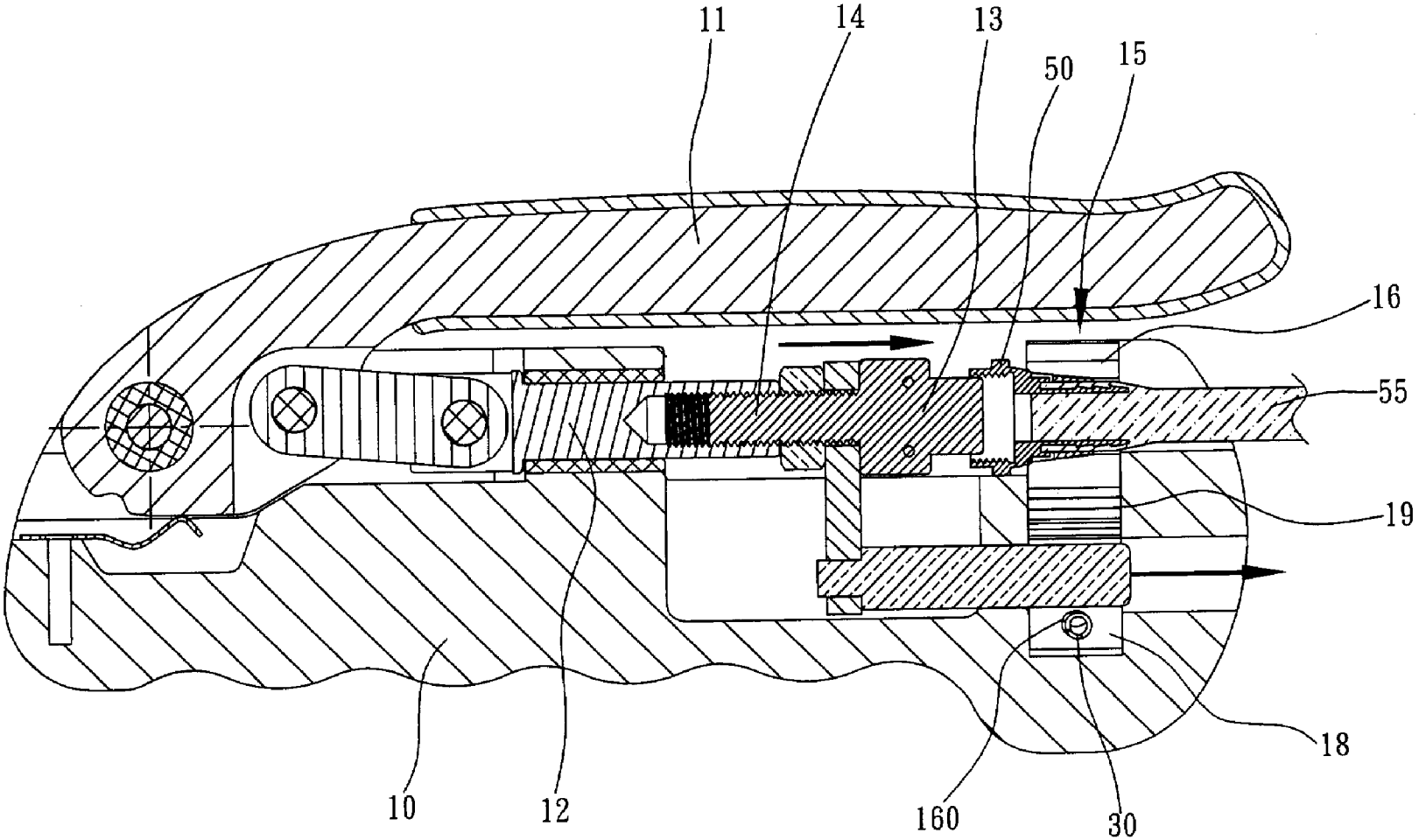
FIG. 6 is a schematic operational view of the contraction tool as shown in FIG. 3 in use.

When the press rod 11 is pivoted downward relative to the main body 10 as shown in FIG. 6, the movable shaft 12 is moved forward by pivot of the press rod 11 to push the push rod 13 forward, so as to push and press the terminal head 50 into the end portion of the cable 55.

At the same time, the limit rod 25 of the urging member 20 is also moved forward by the push rod 13 and is inserted between the tapered faces 18 of the two press plates 16 of the pressing unit 15 as shown in FIG. 7 so as to press and fix the two press plates 16 of the pressing unit 15, so that the two press plates 16 of the pressing unit 15 will not be pivoted outward, thereby clamping the terminal head 50 between the two press plates 16 of the pressing unit 15 rigidly and stably, so that the terminal head 50 can be pressed into the end portion of the cable 55 easily and conveniently.

Figure 8:
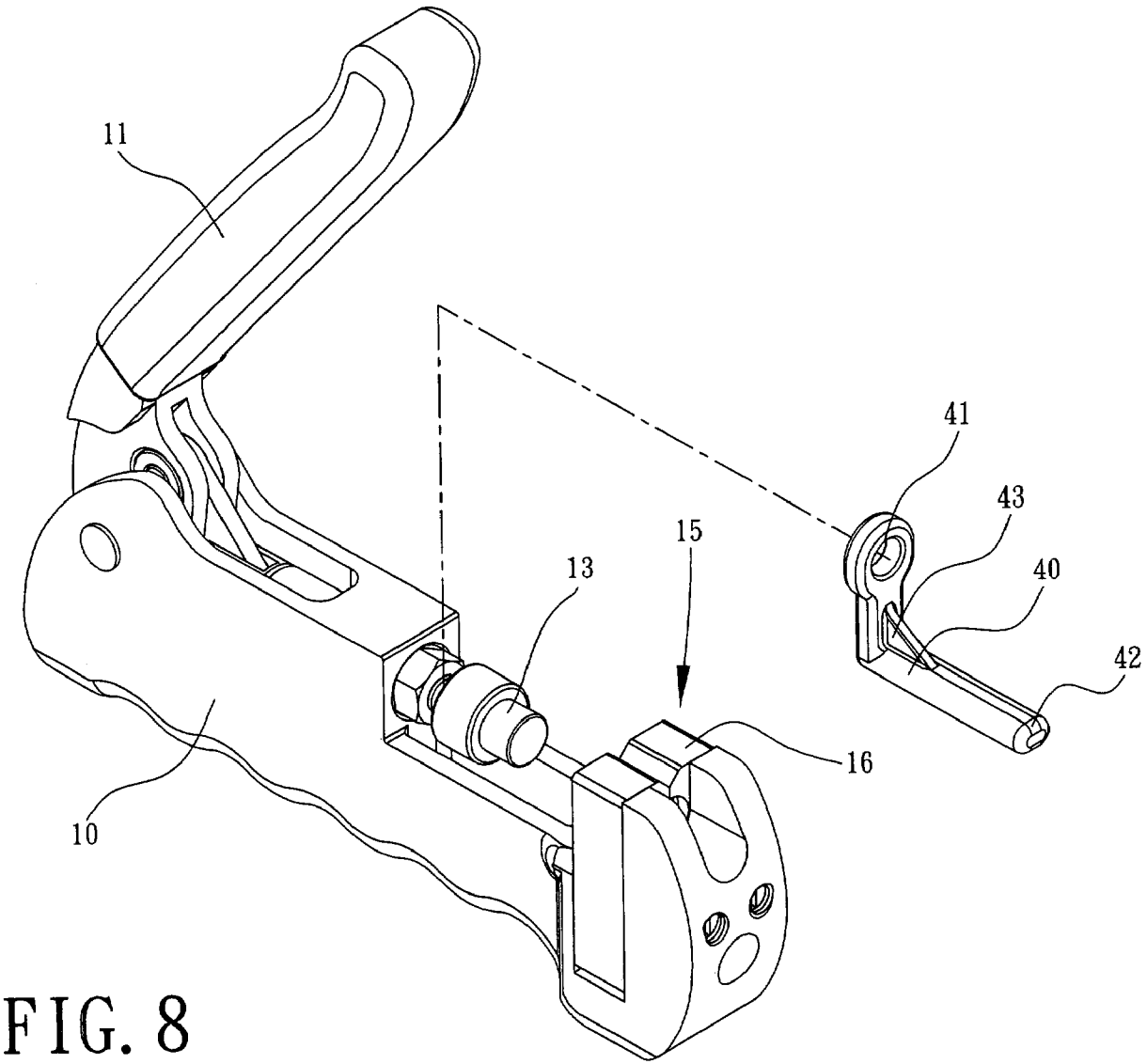
FIG. 8 is a partially exploded perspective view of a contraction tool in accordance with another embodiment of the present invention.

Referring to FIG. 8, the contraction tool in accordance with another embodiment of the present invention is shown, wherein the urging member 40 is substantially L-shaped, and includes a vertical mounting section 41 mounted on the threaded rod 14 of the push rod 13 to move therewith, and a horizontal limit section 42 inserted between the tapered faces 18 of the two press plates 16 of the pressing unit 15. In addition, the urging member 40 further includes a triangular rib 43 mounted between the mounting section 41 and the limit section 42 to enhance the strength of the urging member 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A contraction tool for terminating a cable with a connector, comprising a main body, a press rod pivotally mounted on a first end of the main body, and a pressing unit mounted on a second end of the main body, wherein:

the pressing unit includes two press plates each pivotally mounted on the second end of the main body;

each of the two press plates of the pressing unit has an upper section formed with a positioning recess for holding said connector and a lower section formed with a tapered face;

the contraction tool further comprises a push rod that is movable relative to the main body toward the positioning recesses of the two press plates of the pressing unit;

the contraction tool further comprises an urging member mounted on the push rod to move therewith synchronously; and the urging member contacts the tapered faces of the two press plates of the pressing unit when the push rod is advanced toward the positioning recesses of the two press plates of the pressing unit to cause the upper sections of the two press plates to pivot toward each other.

2. The contraction tool in accordance with claim 1, wherein the tapered face of each of the two press plates of the pressing unit is directed outward.

3. The contraction tool in accordance with claim 1, wherein each of the two press plates of the pressing unit has a mediate section formed with a plurality of ratchet teeth.

4. The contraction tool in accordance with claim 3, wherein the ratchet teeth of the two press plates of the pressing unit mesh with each other, so that the two press plates of the pressing unit are pivoted relative to each other in a synchronous manner.

5. The contraction tool in accordance with claim 1, further comprising a movable shaft movably mounted in the main body and having a first end pivotally connected to the press rod so that the movable shaft can be moved in the main body by pivot of the press rod.

6. The contraction tool in accordance with claim 5, wherein the push rod is secured on a second end of the movable shaft to move therewith and protruded outward from the main body.

7. The contraction tool in accordance with claim 6, wherein the second end of the movable shaft is formed with an inner thread, and the push rod has a first end formed with a threaded rod screwed into the inner thread of the movable shaft, so that the push rod is secured on the movable shaft to move therewith.

8. The contraction tool in accordance with claim 7, wherein the push rod has a second end facing the positioning recesses of the two press plates of the pressing unit.

9. The contraction tool in accordance with claim 1, wherein the urging member includes a linking plate having a first end mounted on the threaded rod of the push rod to move therewith, and a limit rod having a first end secured on a second end of the linking plate and a second end facing the tapered faces of the two press plates of the pressing unit.

10. The contraction tool in accordance with claim 9, wherein the first end of the linking plate of the urging member is formed with a mounting hole for mounting the threaded rod of the push rod.

11. The contraction tool in accordance with claim 9, wherein the second end of the linking plate of the urging member is formed with an insertion hole, and the first end of the limit rod of the urging member is formed with a locking end inserted into and locked in the insertion hole of the linking plate, so that the limit rod is secured on the linking plate to move therewith.

12. The contraction tool in accordance with claim 9, wherein the urging member and the push rod are moved toward the pressing unit synchronously, so that the limit rod of the urging member can be inserted between the tapered faces of the two press plates of the pressing unit to close the upper sections of the two press plates of the pressing unit.

13. The contraction tool in accordance with claim 1, further comprising a spring mounted between the tapered faces of the two press plates of the pressing unit.

14. The contraction tool in accordance with claim 13, wherein the tapered face of each of the two press plates of the pressing unit is formed with a receiving hole to receive an end of the spring.

15. The contraction tool in accordance with claim 1, wherein the urging member is substantially L-shaped, and includes a vertical mounting section mounted on the push rod to move therewith, and a horizontal limit section inserted between the tapered faces of the two press plates of the pressing unit.

16. The contraction tool in accordance with claim 15, wherein the urging member further includes a triangular rib mounted between the mounting section and the limit section.

* * * * *